US007585089B2

(12) United States Patent
Swantner et al.

(10) Patent No.: US 7,585,089 B2
(45) Date of Patent: Sep. 8, 2009

(54) LIGHT ENGINE

(75) Inventors: Michael J. Swantner, Saxonburg, PA (US); Douglas G. Seymour, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 120 days.

(21) Appl. No.: 11/519,659

(22) Filed: Sep. 12, 2006

(65) Prior Publication Data

US 2008/0062696 A1 Mar. 13, 2008

(51) Int. Cl.

| | |
|---|---|
| ***F21V 1/00*** | (2006.01) |
| ***F21V 11/00*** | (2006.01) |
| ***F21S 4/00*** | (2006.01) |
| ***F21V 21/00*** | (2006.01) |

(52) U.S. Cl. ..... 362/235; 362/800; 362/555; 362/249; 362/252; 362/217; 362/551; 362/553; 362/554; 362/249.02

(58) Field of Classification Search ..... None
See application file for complete search history.

(56) References Cited

U.S. PATENT DOCUMENTS

| | | | | |
|---|---|---|---|---|
| 6,160,948 | A * | 12/2000 | McGaffigan | 385/146 |
| 6,612,717 | B2 * | 9/2003 | Yen | 362/245 |
| 6,637,924 | B2 * | 10/2003 | Pelka et al. | 362/555 |
| 2001/0048603 | A1 * | 12/2001 | Ohuchi | 362/555 |
| 2003/0223247 | A1 * | 12/2003 | Karras | 362/555 |
| 2005/0221659 | A1 * | 10/2005 | Mrakovich et al. | 439/404 |

* cited by examiner

*Primary Examiner*—Bao Q Truong
*Assistant Examiner*—Danielle Allen
(74) *Attorney, Agent, or Firm*—William H. McNeill

(57) ABSTRACT

A light engine (10) has a light engine subassembly (12) comprising: a housing (14) having a longitudinal axis (16), a tubular portion (18) with a surrounding wall (20) and a closed end (22). A slot (24) is formed in the surrounding wall (20) and terminates at the closed end (22). A solid-state light source (26) is mounted adjacent the closed end (22), the solid-sate light source having energizing wires attached thereto and exiting the housing via the slot (24). A light dispenser (36) having a first end (37) is fixed in the tubular portion (18) and extends for a given distance along the longitudinal axis (16). The light engine can be used for backlighting.

12 Claims, 1 Drawing Sheet

LIGHT ENGINE

TECHNICAL FIELD

This invention relates to light engines and more particularly to solid-state light engines for providing backlighting.

BACKGROUND ART

Backlighting for signage has often employed incandescent, fluorescent or neon light sources. Recently, solid-state lighting devices such as, for example, light emitting diodes (LED or LEDs) have made inroads as lighting sources for these applications, because of their low power requirements and long life. However, such LED light sources are frequently difficult to mount or to replace.

DISCLOSURE OF INVENTION

Therefore, it is an object of the invention to obviate the disadvantages of the prior art.

It is another object of the invention to enhance lighting devices.

These objects are accomplished, in one aspect of the invention, by the provision of a light engine that comprises; a light engine subassembly having a housing having a longitudinal axis, the housing including a tubular portion with a surrounding wall and a closed end; a slot formed in the surrounding wall terminating at the closed end; a solid-state light source mounted adjacent the closed end, the solid-sate light source having energizing wires attached thereto and exiting the housing via the slot; and a light dispenser having a first end fixed in the tubular portion and extending for a given distance along the longitudinal axis.

This light engine can be made in modular format for multiple arrangements and provides easy mounting and maintenance.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
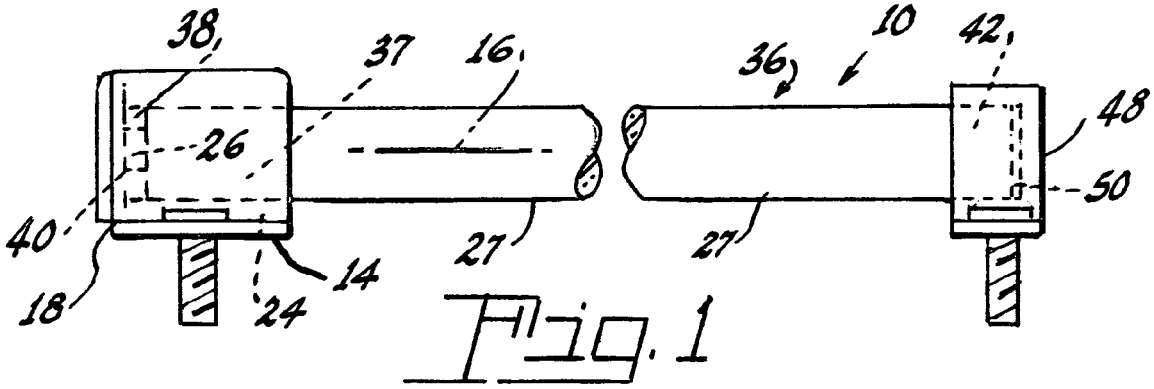
FIG. 1 is a side elevational view of an embodiment of the invention.
Figure 2:
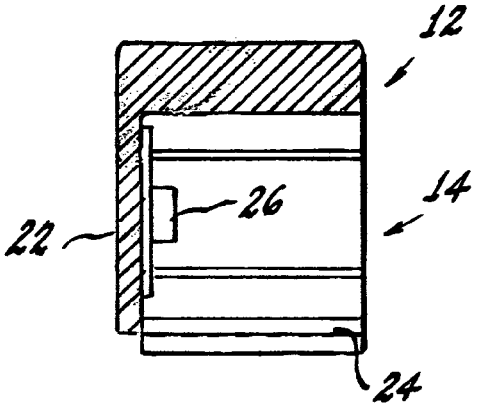
FIG. 2 is an enlarged, sectional view of a light engine subassembly.
Figure 3:
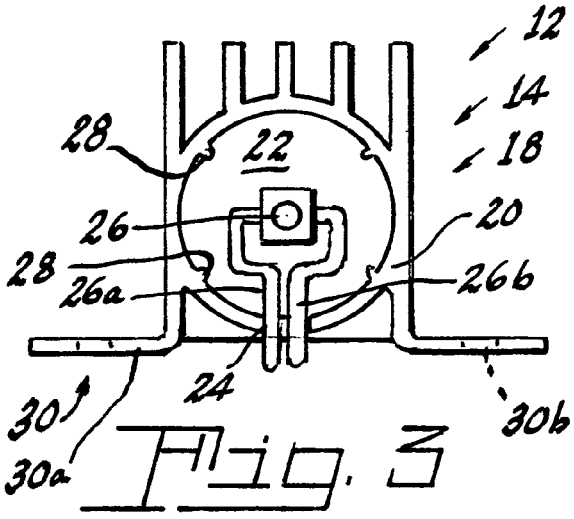
FIG. 3 is an end view of the light engine subassembly.
Figure 4:
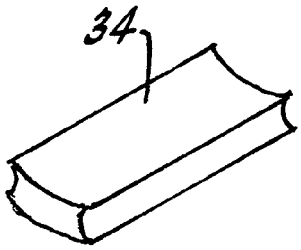
FIG. 4 is a perspective view of sealer for use with the subassembly.
Figure 5:
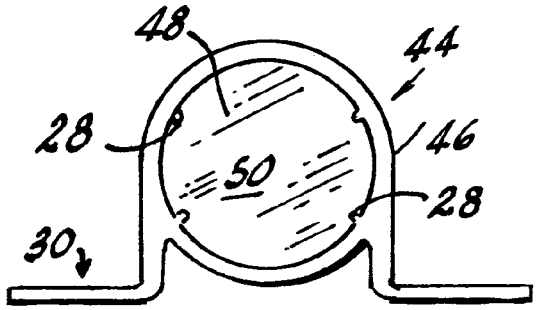
FIG. 5 is an end view of a reflector housing.

Referring now to the drawings with greater particularity, there is shown in FIG.1 a light engine 10 comprising a light engine subassembly 12 comprising a housing 14 having a longitudinal axis 16. The housing 14 is formed from a material having good thermal conductivity and die-cast zinc is preferred. The housing 14 includes a tubular portion 18 with a surrounding wall 20 and a closed end 22. A slot 24 is formed in the surrounding wall 20 and terminates at the closed end 22.

A solid-state light source 26, preferably a light emitting diode, is mounted adjacent the closed end 22 by a thermal adhesive 40. The solid-sate light source has energizing wires 26*a* and 26*b* attached thereto and exit the housing via the slot 24 for connection to an appropriate power source.

A light dispenser 36 in the form of an acrylic rod 27 has a first end 37 fixed in the tubular portion 18 and extends for a given distance along the longitudinal axis 16 to a second end 42 fixed in a reflector housing 44.

The reflector housing 44 has a tubular body 46 with a closed end 48 having a reflector coating 50 thereon and is preferably constructed of ABS.

Both the light engine subassembly housing 14 and the reflector housing 44 have a plurality of crush ribs 28 spaced about the interior surfaces thereof to grasp and center the acrylic rod 27, which is subsequently sealed in position by the application of a clear acrylic potting material that is dispensed into the interior of the cup-shaped portions formed by the closed ends and surrounding sidewalls.

Prior to dispensing the acrylic potting material, the wire-receiving slot 24 is sealed by a plug 34. Alternatively, the slot 24 can be sealed by the application of a piece of tape.

The light engine subassembly housing 14 and the reflector housing 44 are provided with mounting means 30. The mounting means 30 can preferably comprise extending flanges 30*a* having elongated mounting apertures 30*b* formed therein for receiving threaded studs such as bolts or screws.

Thus there is provided a light engine that is easy to mount, has long life and ready adaptability to many lighting applications. The length of the acrylic rod, as well as its shape can be varied to fit many situations. Further, multiple light engines can be arranged in arrays to provide lighting over a wide area. The power, color and number of LEDs can be varied to supply many solutions.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A light engine subassembly for a light engine comprising;

a housing having a longitudinal axis, said housing including a tubular portion with a surrounding wall and a closed end;

a slot formed in said surrounding wall terminating at said closed end; and a solid-state light source mounted adjacent said closed end, said solid-sate light source having energizing wires attached thereto and exiting said housing via said slot.

2. The light engine subassembly of claim 1 wherein said tubular portion includes a plurality of ribs formed on the inside surface thereof.

3. The light engine subassembly of claim 1 wherein said housing includes mounting means.

4. The light engine subassembly of claim 1 wherein a side of said housing includes a plurality of heat-radiating fins.

5. The light engine subassembly of claim 4 wherein said plurality of heat-radiating ribs is positioned opposite said slot.

6. The light engine subassembly of claim 1 wherein said slot is sealed by a plug.

7. A light engine comprising;

a light engine subassembly comprising:

a housing having a longitudinal axis, said housing including a tubular portion with a surrounding wall and a closed end;

a slot formed in said surrounding wall terminating at said closed end;

a solid-state light source mounted adjacent said closed end, said solid-sate light source having energizing wires attached thereto and exiting said housing via said slot; and a light dispenser having a first end fixed in said tubular portion and extending for a given distance along said longitudinal axis.

8. The light engine of claim 7 wherein said light dispenser is an acrylic rod.

9. The light engine of claim 8 wherein said acrylic rod is fixed in said tubular portion by an acrylic potting material.

10. The light engine of claim 7 wherein said solid-state light source is mounted to said closed end by a thermal adhesive.

11. The light engine of claim 7 wherein said light dispenser has a second end fixed in a reflector housing.

12. The light engine of claim 11 wherein said reflector housing comprises a tubular body having a closed end with a reflector surface formed thereon.

* * * * *